US005613687A

United States Patent [19]

Zaffino

[11] Patent Number: 5,613,687

[45] Date of Patent: Mar. 25, 1997

[54] PORTABLE GAME AND AMUSEMENT DEVICE

[76] Inventor: John Zaffino, 3633 Indigo Crescent, Mississauga, Ontario, Canada, L5N 7J1

[21] Appl. No.: 653,713

[22] Filed: May 23, 1996

[51] Int. Cl.[6] ..... A63B 71/02

[52] U.S. Cl. ..... 273/108.5; 273/129 K

[58] Field of Search ..... 273/411, 57.2, 273/108 R, 108.1, 118 R, 126 R

[56] References Cited

U.S. PATENT DOCUMENTS 5,242,164 9/1993 Nicoll ..... 273/126 R X 5,454,566 10/1995 Koenig ..... 273/126 R

*Primary Examiner*—William H. Grieb

*Attorney, Agent, or Firm*—Merek & Voorhees

[57] ABSTRACT

A portable game and amusement device that is comprised of a flexible sheet defining a playing surface, a series of framing members that are capable of being arranged in a substantially closed figure situated on the flexible sheet, and fastening means that releasably securing the framing members to the upper surface of the flexible sheet in the substantially closed figure. The fastening means hold the framing members in a fixed position on the upper surface of the flexible sheet and also hold the flexible sheet in a taut configuration beneath the framing members. When the framing members are releasably secured to the flexible sheet to form the substantially closed figure, they define a playing arena within the interior of the substantially closed figure with the playing arena providing a means to contain a game piece that is rolled or slid along the flexible sheet.

18 Claims, 7 Drawing Sheets

PORTABLE GAME AND AMUSEMENT DEVICE

FIELD OF THE INVENTION

This invention relates to a portable game or amusement device of the type that can be readily dis-assembled and transported from place to place. More specifically, the invention relates to a transportable playing surface or arena that players can utilize to play simulated games in the nature of hockey or soccer.

BACKGROUND OF THE INVENTION

Games and amusement devices are used and enjoyed by the young and old alike. One specific classification of games and amusement devices that is particularly popular concerns those that simulate professional team sporting events that have a large public following and high media profile. Such sports include hockey, soccer, football and baseball. Due to their popularity, a wide variety of different devices and games have been created to emulate the playing of these sporting events. For example, others have developed various types and forms of miniaturized playing surfaces which can be used to simulate the playing of such professional sports. These playing surfaces are usually comprised of rigid sheets of material surrounded by a rigid frame that is meant to represent an arena or playing field.

While such prior devices tend to provide a means to engage in a simulated game of a particular sport, they suffer from a number of inherent difficulties and limitations. First, due to their size, they often tend not to be readily portable, and when not in use require a considerable amount of space for storage. In addition, their size and rigidity make transporting such devices by children either impossible or difficult. Such devices have also generally tended to be mechanically complex and expensive, thereby limiting their availability to some individuals.

SUMMARY OF THE INVENTION

The invention therefore provides a portable game and amusement device which overcomes the limitations of such prior devices. The invention provides a game and amusement device that can be used to play a simulated game of a professional sport such as hockey, soccer, football or baseball, is simple in construction, and is easily dis-assembled for storage or transportation.

Accordingly, in one of its aspects the invention provides a portable game and amusement device comprising a flexible sheet which generally defines a playing surface; a series of framing members, said framing members capable of being arranged in a substantially closed figure situated on said flexible sheet; and, fastening means, said fastening means releasably securing said framing members to the upper surface of said flexible sheet in said substantially closed figure and thereby holding said framing members in a fixed position on said upper surface of said flexible sheet and also holding said flexible sheet in a taut configuration beneath said framing members, said framing members when releasably secured to said flexible playing sheet to form said substantially closed figure defining a playing arena within the interior of said generally closed figure, said playing arena providing a means to contain a game piece that is rolled or slid along said flexible sheet.

Further objects and advantages of the invention will become apparent from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
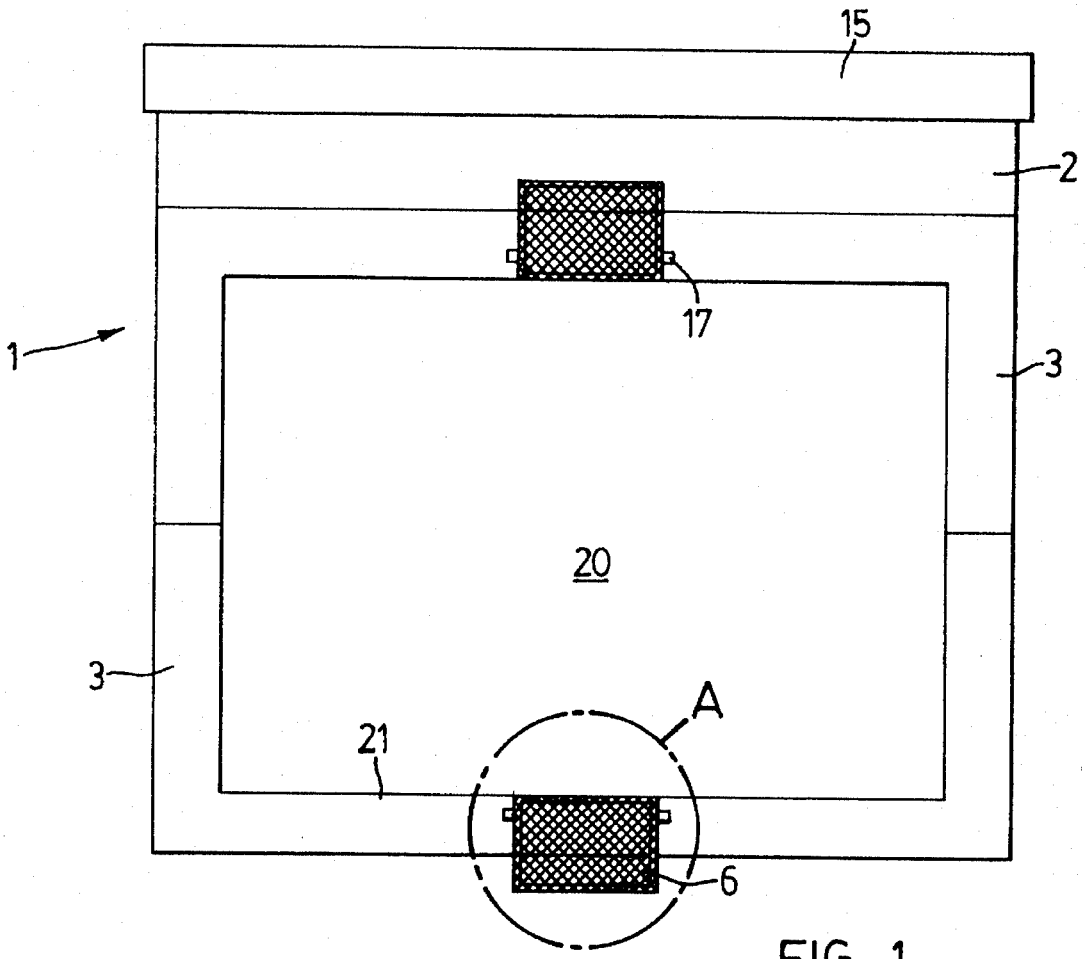
FIG. 1 is a top or plan view of the portable game and amusement device according to the present invention.

In the attached drawings, the portable game and amusement device of the present invention is noted generally by the reference numeral 1. Device 1 is comprised primarily of a flexible sheet 2 and a series of framing members 3. Flexible sheet 2 generally defines a playing surface upon which framing members 3 are arranged in a substantially closed figure. In the preferred embodiment, flexible sheet 2 is generally rectangular in shape and the enclosed figure formed by framing members 3 when in their assembled position is a rectangular shaped polygon. However, it will be appreciated that a variety of additional shapes could be created using framing members 3 while staying within the scope of the invention.

In order to releasably secure framing members 3 to flexible sheet 2, device 1 utilizes fastening means 4. Fastening means 4 (see FIG. 5) releasably secure framing members 3 to the upper surface 16 of flexible sheet 2 in a substantially closed figure configuration. Fastening means 4 not only hold framing members 3 in a fixed position on the upper surface 16 of flexible sheet 2, but also serve as a means to hold flexible sheet 2 in a taut configuration beneath framing members 3.

Figure 7:
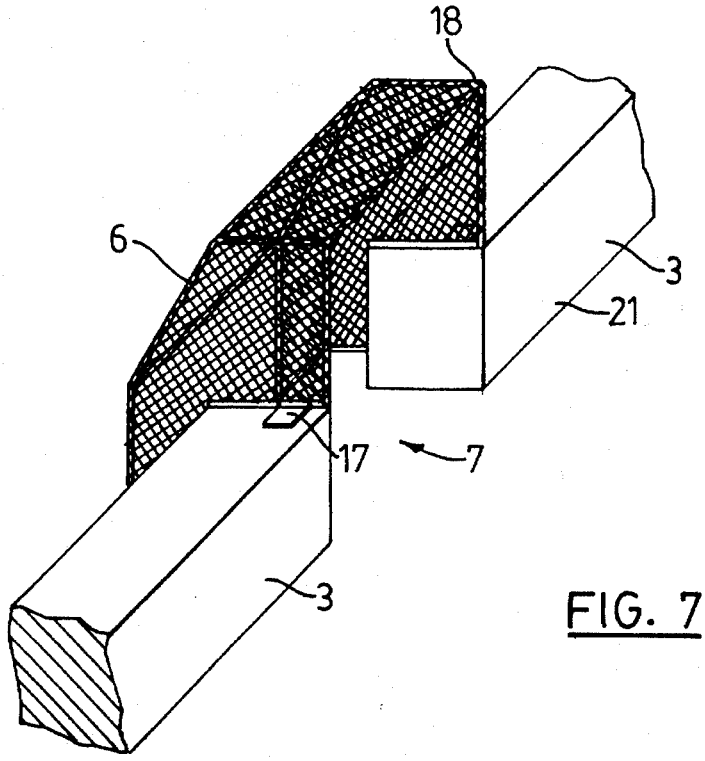
FIG. 7 is a front perspective and detailed view of area "A" of FIG. 1.

Referring now to FIGS. 1 and 7, when flaming members 3 are positioned and releasably secured, by way of fastening means 4, on the upper surface 16 of flexible sheet 2 they form a figure that is closed with the exception of two gaps 7 situated between adjacent flaming members 3. The gaps 7 are preferably positioned along opposing sides of the substantially closed figure and facing each other. Spanning each gap 7 is a net member 6. Net members 6 are releasably secured to adjacent flaming members 3 by way of fasteners 17 which are preferably comprised of hook and loop fasteners to facilitate easy attachment and removal. As shown more clearly in FIG. 7, net members 6 are generally comprised of a hollow, box-like structure having an open side that faces inwardly into the substantially closed figure created by flaming members 3. The sides of net members 6 may be solid or may be comprised of a mesh material retained around a rigid frame 18. It will be appreciated that through the placement of net members 6 within gaps 7, the combination of flaming members 3 and net members 6 will form a fully and completely enclosed polygonal figure.

Figure 2:
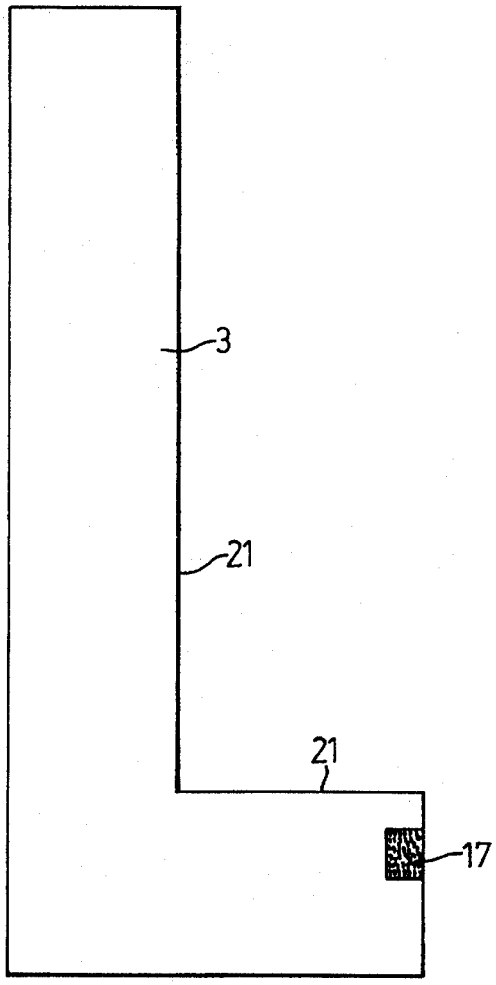
FIG. 2 is a top or plan view of a framing member which comprises part of the invention shown in FIG. 1.
Figure 3:
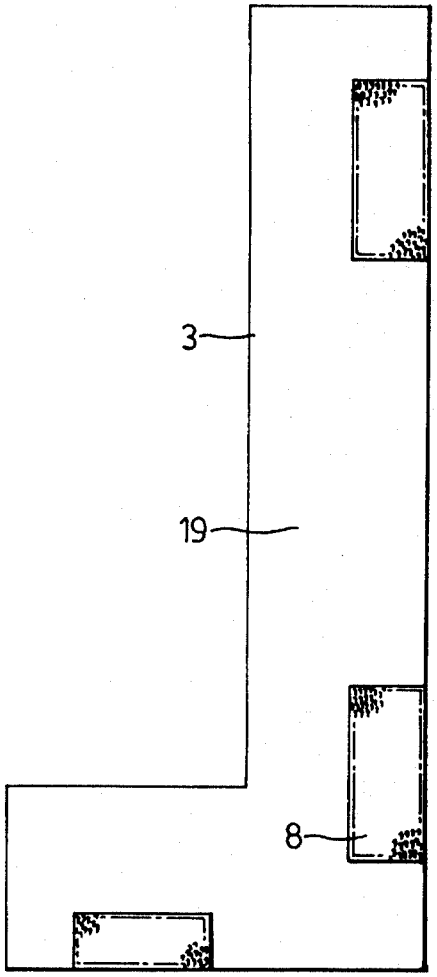
FIG. 3 is a bottom view of the framing member shown in FIG. 2.
Figure 4:
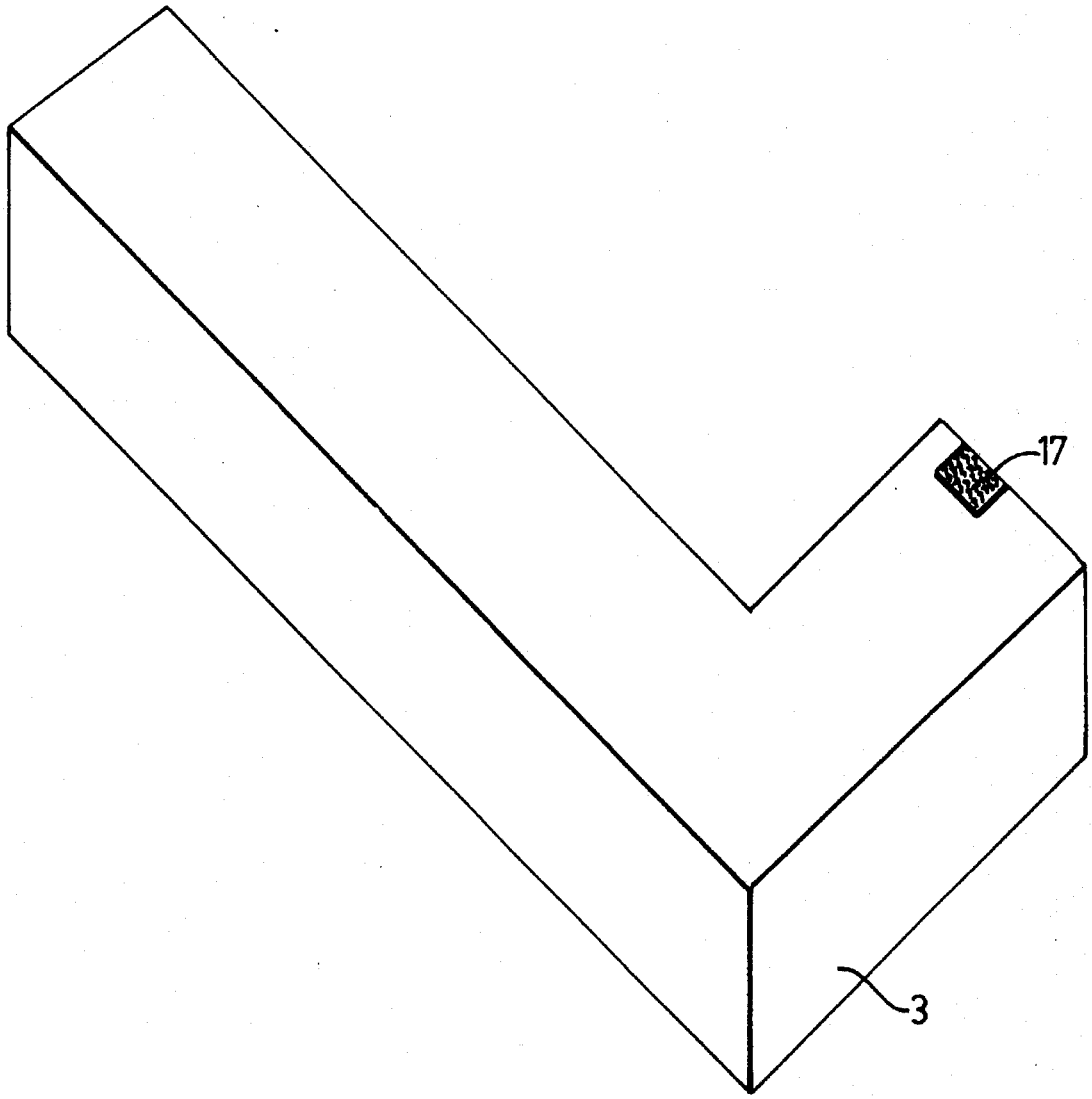
FIG. 4 is a top perspective view of the framing member shown in FIG. 2.
Figure 6:
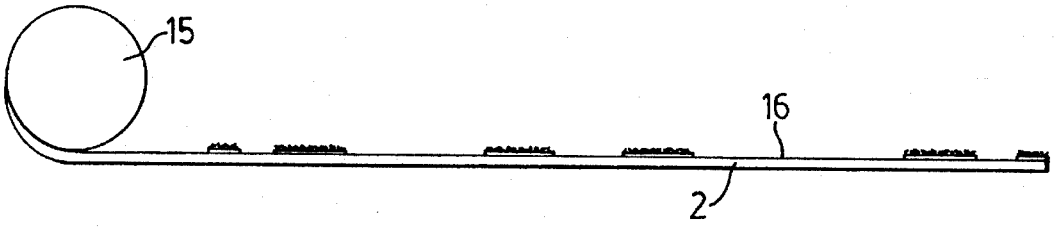
FIG. 6 is a side view of the flexible sheet of FIG. 5.

The preferred structure of framing members 3 is shown more clearly in FIGS. 2, 3 and 4. Framing members 3 are generally L-shaped and are substantially the same size dimensionally. Constructing framing members 3 in this fashion has the advantage of simplifying the manufacturing process and thereby reducing overall costs. In addition, when framing members 3 are removed from flexible sheet 2 they can be arranged or stacked side by side making for easy storage and transportation (See FIG. 9). Further, it will be appreciated that this particular configuration of framing members 3 also allow them to be used, separately from the remainder of device 1, as miniature hockey sticks for playing simulated games of hockey.

In the preferred embodiment fastening means 4 comprise a series of hook and loop fasteners 8 secured to framing members 3 and flexible sheet 2. Although it is not critical whether the hook or loop portion of the fasteners is attached to flexible sheet 2 or framing members 3, it is preferable that consistency be maintained and that either all of the hook or all of the loop portions of fastening means 4 be attached to either flexible sheet 2 or framing members 3.

Figure 5:
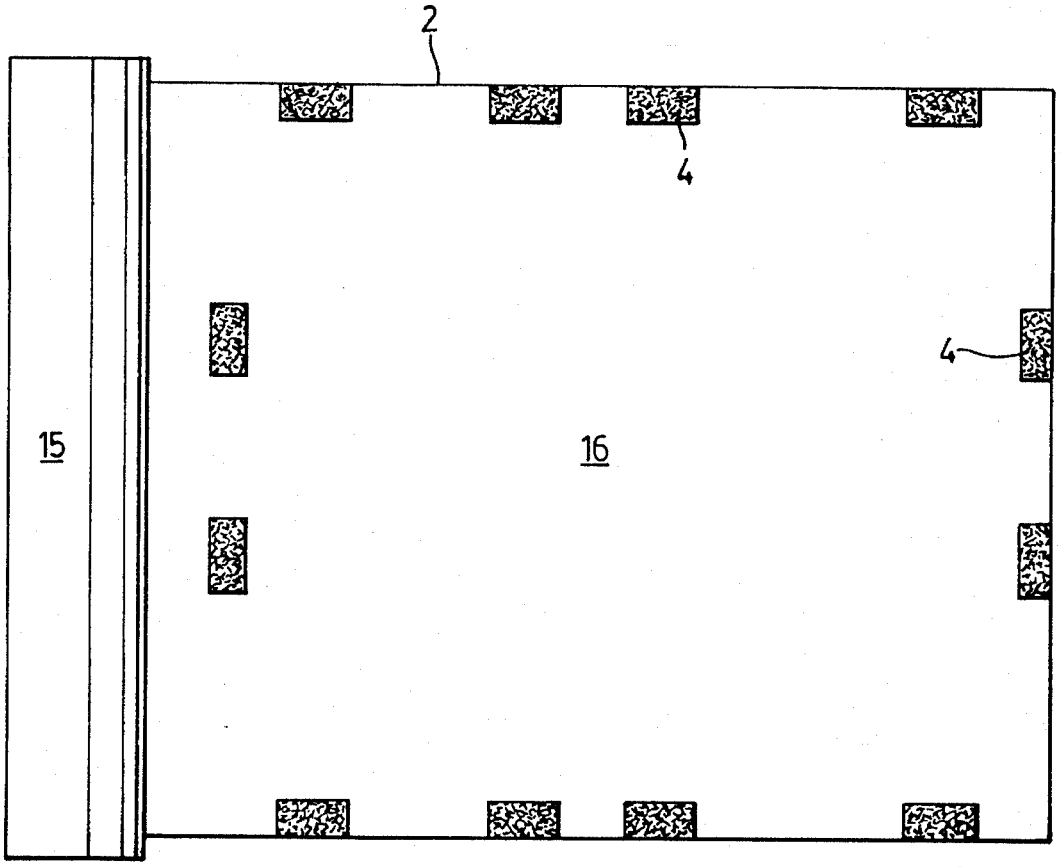
FIG. 5 is a top or plan view of the flexible sheet which comprises part of the invention shown in FIG. 1.

As shown in FIG. 5, one of the portions of hook and loop fasteners 8 is attached generally around the exterior perimeter of the upper surface 16 of flexible sheet 2. As shown in FIG. 3, the other, and corresponding, portions of hook and loop fasteners 8 are secured to the bottom surface 19 of framing members 3. It will therefore be appreciated that through placing framing members 3 upon the upper surface 16 of flexible sheet 2, and aligning corresponding and respective portions of hook and loop fasteners 8, the substantially closed figure as shown in FIG. 1 will be created. Hook and loop fasteners 8 will securely hold framing members 3 onto flexible sheet 2 and also hold flexible sheet 2 in a taut or tight configuration beneath framing members 3. The enclosed polygonal figure formed by framing members 3 and net members 6, together with flexible sheet 2, defines a playing arena within the enclosed figure.

It will be understood that this playing arena as described above will provide a containment area for a game piece which may be moved around within the interior 20 of the closed figure. In most instances the game piece will comprise a small ball or disc that can be readily rolled or slid around the interior 20 of the enclosed figure. To facilitate the rolling or sliding of the game piece, flexible sheet 2 is preferably comprised of plastic, vinyl or a canvass material. To simulate the playing of a sporting event, the upper surface 16 of flexible sheet 2 preferably includes graphical representations corresponding to a hockey ice surface or a soccer field. As a game piece is moved or slid along flexible sheet 2 it will be prevented from leaving interior 20 of the enclosed figure through contact with the interior side surfaces 21 of framing members 3. Where the game piece enters one of the gaps 7, it will be contained by a net member 6.

When individuals engage in a game of simulated hockey, soccer or other sporting event utilizing device 1, each individual will typically be assigned a net member 6. A game piece can then be moved about interior 20 with the object of attempting to force the game piece into an opponent's net to accumulate points. Typically a game would be played until a certain number of points are accumulated by one of the players, or for a specific time duration.

Figure 8:
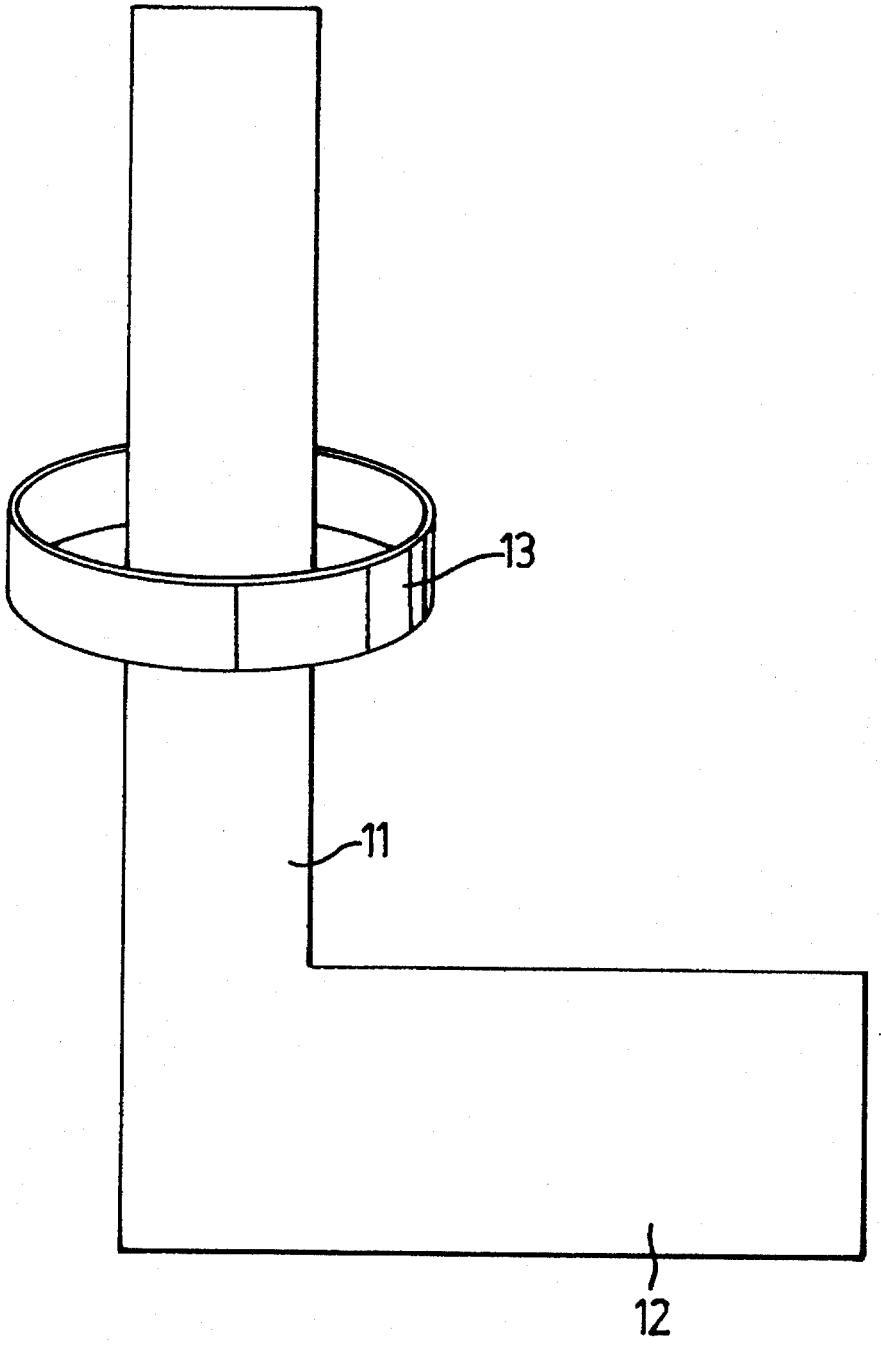
FIG. 8 is a front perspective view of a striker according to the portable game and amusement device of the present invention.
Figure 10:
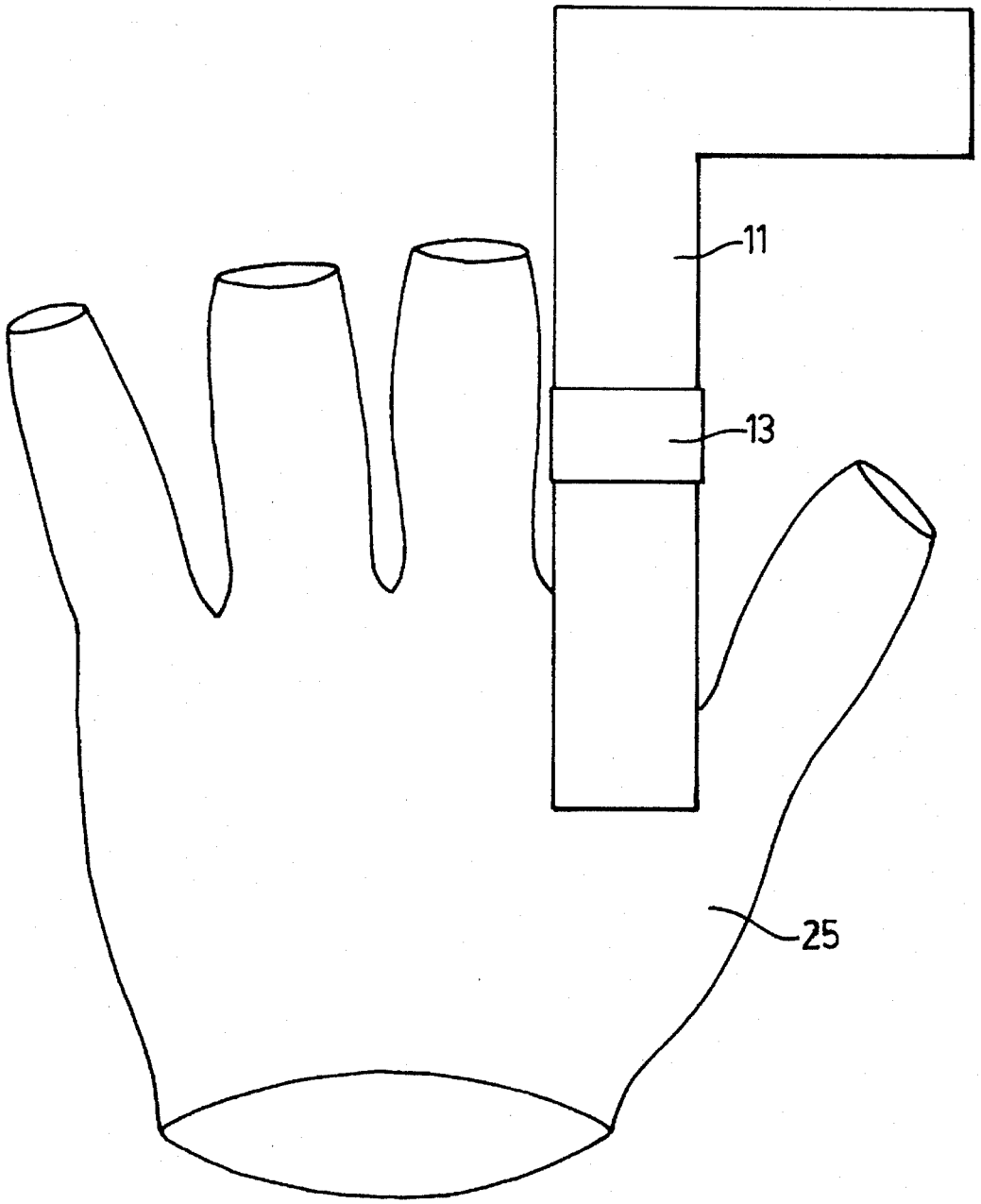

To facilitate with the movement of the game piece, device 1 preferably also includes a striker 11 that is releasably securable to a player's finger or hand. As shown in FIG. 8, striker 11 is generally L-shaped and includes an impact surface 12 that may be used for hitting, directing or moving the game piece along the upper surface 16 of flexible sheet 2. Striker 11 is releasably securable to a player's finger or hand through a fastening means 13 which, in the preferred embodiment, is comprised of an elasticized band or a hook and loop fastener. In another embodiment, and as shown in FIG. 10, striker 11 is fixed to a glove or mitten 25 that may be worn by a player. The glove or mitten 25 provides support for striker 11 and also provides a level of protection for the hand of the player.

When device 1 is not in use, it can be readily dis-assembled for storage and transportation. As described above, the use of fastening means 4 enables framing members 3 to be readily removed from flexible sheet 2. Similarly, fastener 17 allows for the quick and easy dis-assembly of net members 6. With framing members 3 and net members 6 removed, flexible sheet 2 can then be rolled up into a more compact form. To assist in the rolling of flexible sheet 2, and to provide rigid support to prevent damage or kinking, a rod 15 (see FIG. 5) is preferably attached to one of the side edges of flexible sheet 2. Sheet 2 can then be rolled or wound around rod 15.

Figure 9:
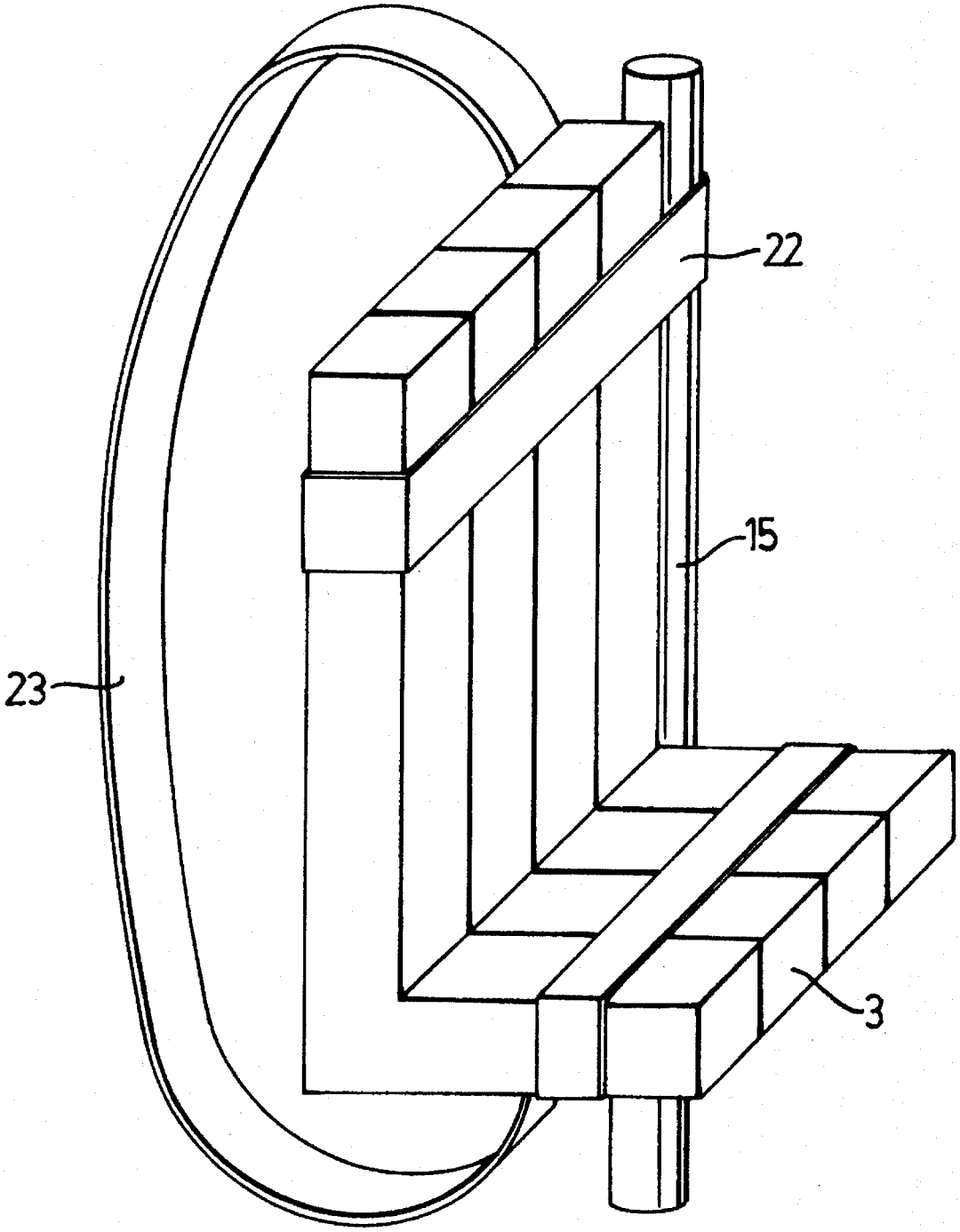
FIG. 9 is a front perspective view of the device of FIG. 1 in a dis-assembled state and ready for transport; and, FIG. 10 is a view of an alternate embodiment of the striker shown in FIG. 8.

As shown in FIG. 9, when dis-assembled, framing members 3 can be placed side by side and, together with flexible sheet 2 which has been wound around rod 15, held together through the use of carrying means 22. Carrying means 22 is preferably comprised of an elasticised material or a hook or loop fastener that enables it to be releasably secured to flexible sheet 2 and framing members 3, while still enabling them to be held in a tight configuration. Carrying means 22 also includes a strap 23 to allow the dis-assembled device to be easily carried by hand or slung over an individual's shoulder.

It is to be understood that what has been described are the preferred embodiments of the invention and that it is possible to make variations to these embodiments while staying within the broad scope of the invention. Some of these variations have been discussed while others will be readily apparent to those skilled in the art. For example, while fastening means 4 have been described in the preferred embodiment as comprising hook and loop fasteners 8, it will be appreciated that a variety of other fastening means could equally be used while staying within the broad scope of the invention. Similarly, while in the preferred embodiment framing members 3 are configured to form a generally rectangular shaped structure, the shape of individual framing members 3 could be altered to create a wide variety of other polygonal figures when the device is assembled. It will also be appreciated that striker 11 could equally be held on the hand of a player through the use of a ring that is formed integrally with the striker, or that it may merely be held between the fingers of a player without the use of any means of direct attachment.

I claim:

1. A portable game and amusement device comprising:

(a) a flexible sheet which generally defines a playing surface;

(b) a series of framing members, said framing members capable of being arranged in a substantially closed figure situated on said flexible sheet;

(c) fastening means, said fastening means releasably securing said framing members to the upper surface of said flexible sheet in said substantially closed figure and thereby holding said flaming members in a fixed position on said upper surface of said flexible sheet and also holding said flexible sheet in a taut configuration beneath said framing members; and, (d) a pair of net members releasably securable to said framing members and positioned opposite one another when said framing members are arranged in said substantially closed figure, said framing members when releasably secured to said flexible sheet to form said substantially closed figure defining a playing arena within the interior of said substantially closed figure, said playing arena providing a means to contain a game piece that is rolled or slid along said flexible sheet.

2. A device as claimed in claim 1 including carrying means releasably securable to said flexible sheet and said framing members to allow said device to be readily transported.

3. A device as claimed in claim 2 wherein said net members are situated within gaps between adjacent framing members, the combination of said framing members and said net members forming a fully enclosed figure.

4. A device as claimed in claim 3 wherein said flexible sheet is generally rectangular and said fully enclosed figure formed by said framing members and said net members is a generally rectangular polygon.

5. A device as claimed in claim 4 wherein said framing members are generally L-shaped and are of generally the same size.

6. A device as claimed in claim 5 wherein said fastening means comprises hook and loop fasteners attached to the upper surface of said flexible sheet and to the bottom surface of said framing members, such that when said framing members are positioned upon said upper surface of said flexible sheet in said substantially closed figure said hook and loop fasteners are engaged to secure said framing members to said flexible sheet.

7. A device as claimed in claim 6 including a striker, said striker releasably securable to the finger or hand of a player of said portable game and amusement device, said striker having an impact surface for hitting or directing said game piece along said upper surface of said flexible sheet.

8. A device as claimed in claim 7 wherein said striker is generally L-shaped and releasably securable to the finger or hand of said player through the use of an elasticized band.

9. A device as claimed in claim 7 wherein said striker is generally L-shaped and releasably securable to the figure or hand of said player through the use of a hook and loop fastener.

10. A device as claimed in claim 7 wherein said striker is generally L-shaped and is attached to a glove that may be worn by the operator of said device.

11. A device as claimed in claim 7 including an elongate rod, said elongate rod providing a base over which said flexible sheet can be rolled or wound for storage and transport.

12. A device as claimed in claim 11 wherein said net members are releasably secured to said framing members through the use of hook and loop fasteners.

13. A device as claimed in claim 12 wherein said carrying means comprises a shoulder strap that can be placed over an individual's shoulder for carrying and transporting said device.

14. A device as claimed in claim 13 wherein said game piece comprises a ball or disc.

15. A device as claimed in claim 14 wherein said flexible sheet is comprised of plastic, vinyl or canvass.

16. A device as claimed in claim 15, wherein said upper surface of said flexible sheet contains graphical representations simulating the ice surface used in the sport of ice hockey.

17. A device as claimed in claim 16 wherein said upper surface of said flexible sheet contains graphical representations simulating the playing field for the sport of soccer.

18. A device as claimed in claim 7 wherein said generally L-shaped framing members may be used as miniature hockey sticks when not releasably secured to said flexible sheet.

* * * * *